US009502844B2

(12) United States Patent
Chen et al.

(10) Patent No.: US 9,502,844 B2
(45) Date of Patent: Nov. 22, 2016

(54) BATTERY CONNECTOR AND TERMINAL THEREOF

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Ping-Chung Chu, New Taipei (TW); Xiao-Juan Qi, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/013,554

(22) Filed: Feb. 2, 2016

(65) Prior Publication Data

US 2016/0226206 A1 Aug. 4, 2016

(30) Foreign Application Priority Data

Feb. 3, 2015 (CN) ..... 2015 1 0055105

(51) Int. Cl.
*H01R 24/76* (2011.01)
*H01R 13/24* (2006.01)

(52) U.S. Cl.
CPC ..... *H01R 24/76* (2013.01); *H01R 13/24* (2013.01)

(58) Field of Classification Search
CPC .. H01R 13/2428; H01R 11/18; H01R 11/281
USPC ..... 439/500, 824, 700, 289
See application file for complete search history.

(56) References Cited

U.S. PATENT DOCUMENTS

| | | | | |
|---|---|---|---|---|
| 6,083,059 | A * | 7/2000 | Kuan | H01R 13/2428 439/482 |
| 6,162,103 | A * | 12/2000 | Ono | H01R 13/2471 439/700 |
| 6,572,386 | B1 * | 6/2003 | Howell | H01R 13/2428 439/66 |
| 7,357,665 | B1 * | 4/2008 | Yan | H01R 13/2442 439/500 |
| 7,607,952 | B2 * | 10/2009 | Tai | H01R 12/57 439/700 |
| 9,088,083 | B2 * | 7/2015 | Mason | H05K 7/1069 |
| 2007/0059976 | A1 * | 3/2007 | Yeh | H01M 2/20 439/500 |
| 2007/0224890 | A1 * | 9/2007 | Chien | H01R 12/57 439/862 |
| 2009/0247004 | A1 * | 10/2009 | Lou | H01R 13/2442 439/500 |

* cited by examiner

*Primary Examiner* — Tulsidas C Patel
*Assistant Examiner* — Marcus Harcum
(74) *Attorney, Agent, or Firm* — Muncy, Geissler, Olds & Lowe, P.C.

(57) ABSTRACT

A battery connector includes an insulation housing and conductive terminals. The insulation housing has slots, and the conductive terminals are held in the slots. Each conductive terminal includes an elastic connecting portion, a contact portion, and a fastening portion. The elastic connecting portion includes elastic arms parallel and substantially aligned along a transversal direction and connecting portions formed at two ends of each of the elastic arms. The contact portion includes a bendable contact portion extended forwardly from the elastic connecting portion and then folded and extended backwardly and an active contact arm formed at an end portion of the bendable contact portion. The fastening portion includes a bent portion extended backwardly from the elastic connecting portion and then folded and extended forwardly and a passive contact arm formed at an end portion of a bent portion and aligned with the active contact arm.

9 Claims, 8 Drawing Sheets

100

100

100

100

BATTERY CONNECTOR AND TERMINAL THEREOF

CROSS-REFERENCES TO RELATED APPLICATIONS

This non-provisional application claims priority under 35 U.S.C. §119(a) on Patent Application No. 201510055105.1 filed in China, P.R.C. on 2015 Feb. 3, the entire contents of which are hereby incorporated by reference.

FIELD OF THE INVENTION

The instant disclosure relates to an electrical connector, and more particular to a battery connector and a terminal thereof.

BACKGROUND

In a typical battery connector, the conductive terminal is a pogo pin. The pogo pin includes a metal pin, a conductive base and a compression spring. The metal pin, the conductive base, and the compression spring are installed in the insulation housing of the connector. The metal pin has a contact end protruded from the insulation housing, the conductive base has a connecting portion connectable with a circuit board, and the compression spring is configured between the two sidewalls of the conductive base. The upper end of the compression spring is abutted against the inner wall of the metal pin, and the lower end of the compression spring is in contact with the conductive base.

When the contact end of the metal pin is pressed into the insulation housing, the metal pin would further forces the compression spring to be compressed, and the abutting end of the metal pin is in contact with arms configured at the two sidewalls of the conductive base. Therefore, the electrical connection of the conductive terminal is achieved. However, the components of the conductive terminal are not integrated as a whole, therefore it takes time to assemble the compression spring between the metal pin and the conductive base, and since the metal pin and the conductive base would be bounced by the compression spring during assembly, it is also difficult to assemble the metal pin and the conductive base to the insulation housing. Therefore, how to solve the aforementioned problems becomes an issue and is diligently developed by related personnel.

SUMMARY OF THE INVENTION

In view of these, a battery connector terminal is provided. In one embodiment, the battery connector terminal comprises an elastic connecting portion, a contact portion, and a fastening portion. The elastic connecting portion comprises a plurality of elastic arms and a plurality of connecting portions. The elastic arms are parallel and substantially aligned along a transversal direction, and the connecting portions are formed at two ends of each of the elastic arms. The contact portion comprises a bendable contact portion and an active contact arm. The bendable contact portion is extended forwardly from the elastic connecting portion and then folded and extended backwardly. The active contact arm is formed at an end portion of the bendable contact portion. The fastening portion comprises a bent portion and a passive contact arm. The bent portion is extended backwardly from the elastic connecting portion and then folded and extended forwardly. The passive contact arm is formed at an end portion of a bent portion and aligned with the active contact arm.

In one embodiment, the active contact arm comprises a protruded portion being detachably in contact with the passive contact arm.

In one embodiment, each of the connecting portions comprises a transition section and a plurality of extension sections. The transition section is connected between two ends of two adjacent elastic arms, and the extension sections are extended from two ends of the transition section and distant from the two ends of the elastic arms.

In one embodiment, the elastic arms comprise a plurality of transverse branch arms aligned sequentially and a plurality of slant branch arms each configured between two adjacent transverse branch arms.

A battery connector is further provided. The battery connector comprises an insulation housing and a plurality of battery connector terminals. The insulation housing comprises a plurality of slots, a plurality of front openings, and a plurality of rear openings. Each of the front openings is in communication with the front portion of the corresponding slot, and each of the rear openings is in communication with the rear portion of the corresponding slot. The battery connector terminals are held in the slots. Each of the battery connector terminals comprises an elastic connecting portion, a contact portion, and a fastening portion. The elastic connecting portion comprises a plurality of elastic arms and a plurality of connecting portions. The elastic arms are parallel and substantially aligned along a transversal direction, and the connecting portions are formed at two ends of each of the elastic arms. Each of the contact portions is protruded from the corresponding front opening and comprises a bendable contact portion and an active contact arm. The bendable contact portion is extended forwardly from the elastic connecting portion and then folded and extended backwardly. The active contact arm is formed at an end portion of the bendable contact portion. Each of the fastening portions is protruded from the corresponding rear opening and comprises a bent portion and a passive contact arm. The bent portion is extended backwardly from the elastic connecting portion and then folded and extended forwardly. The passive contact arm is formed at an end portion of a bent portion and aligned with the active contact arm.

In one embodiment, the battery connector terminals are alternately held in top locations and bottom locations of the slots.

In one embodiment, each of the slots comprises a transverse groove and a longitudinal groove communicating with the longitudinal groove, the battery connector terminals are restricted by the transverse grooves and the longitudinal grooves.

In one embodiment, the fastening portion comprises a fastening piece and a soldering leg extended from the rear portion of the fastening piece Based on the above, the conductive terminals are designed as spring like structures with I-profiled or L-profiled. The conductive terminals are capable of being compressed and providing sufficient elastic force. In addition, the fastening portion has a passive contact arm provided to be in contact with the protruded portion of the contact portion to shorten the electricity transmission path and to increase the normal force of the battery connector. Besides, the elastic connecting portions are alternately held in top locations and bottom locations of the slots, such that the conductive terminals are installed in the slots, with a one-to-one relationship. Therefore, the size of the batter connector can be reduced with the dense arrangement of the conductive terminals, and the manufacturing cost of the battery connector can be reduced as well. Additionally, the space within the battery connector can be utilized efficiently, and the battery connector can be produced in a lightweight manner to meet various requirements.

Detailed description of the characteristics, and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
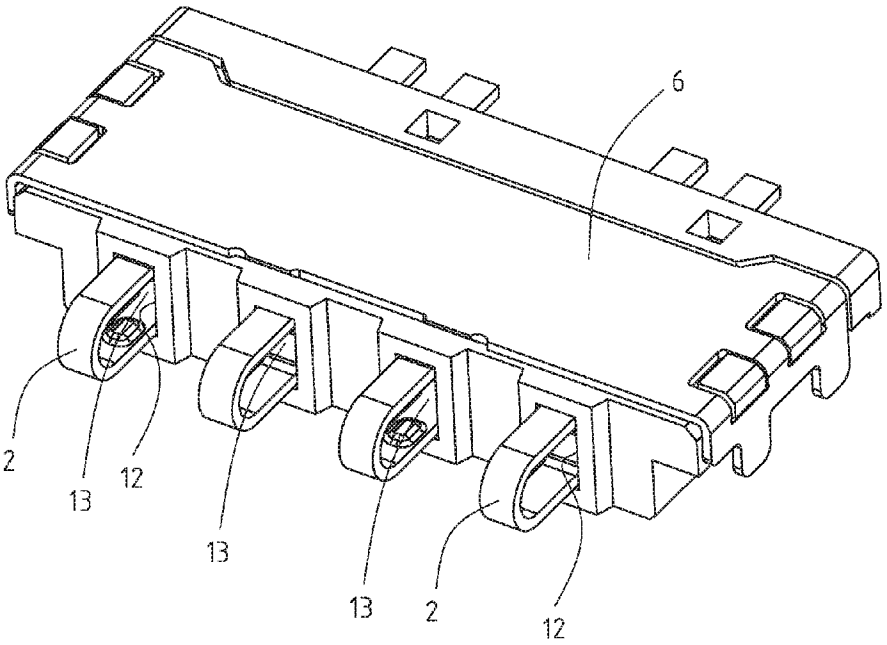
FIG. 1 illustrates a perspective view of a battery connector according to a first embodiment of the instant disclosure.
Figure 2:
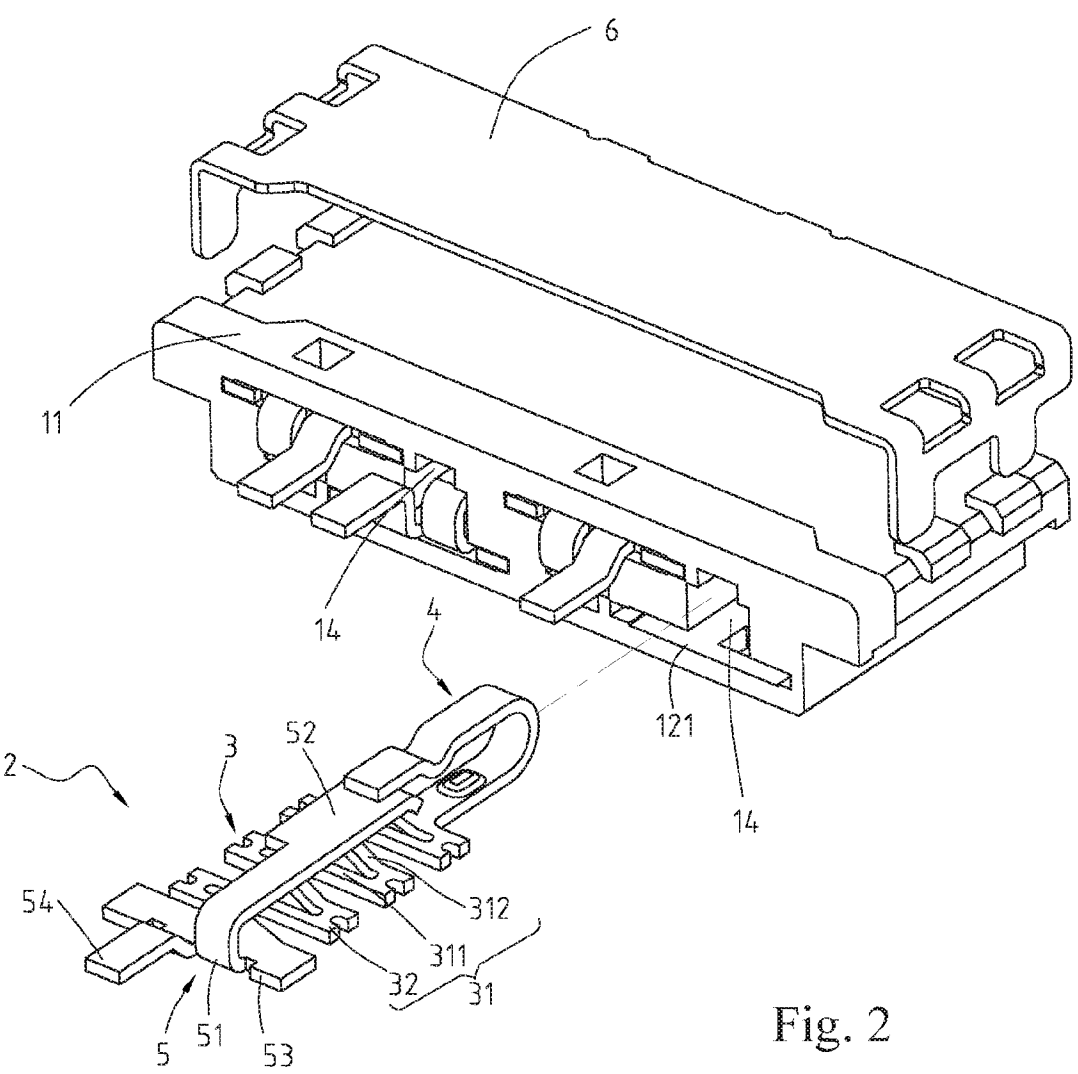
FIG. 2 illustrates an exploded view of the battery connector according to the first embodiment of the instant disclosure.
Figure 3:
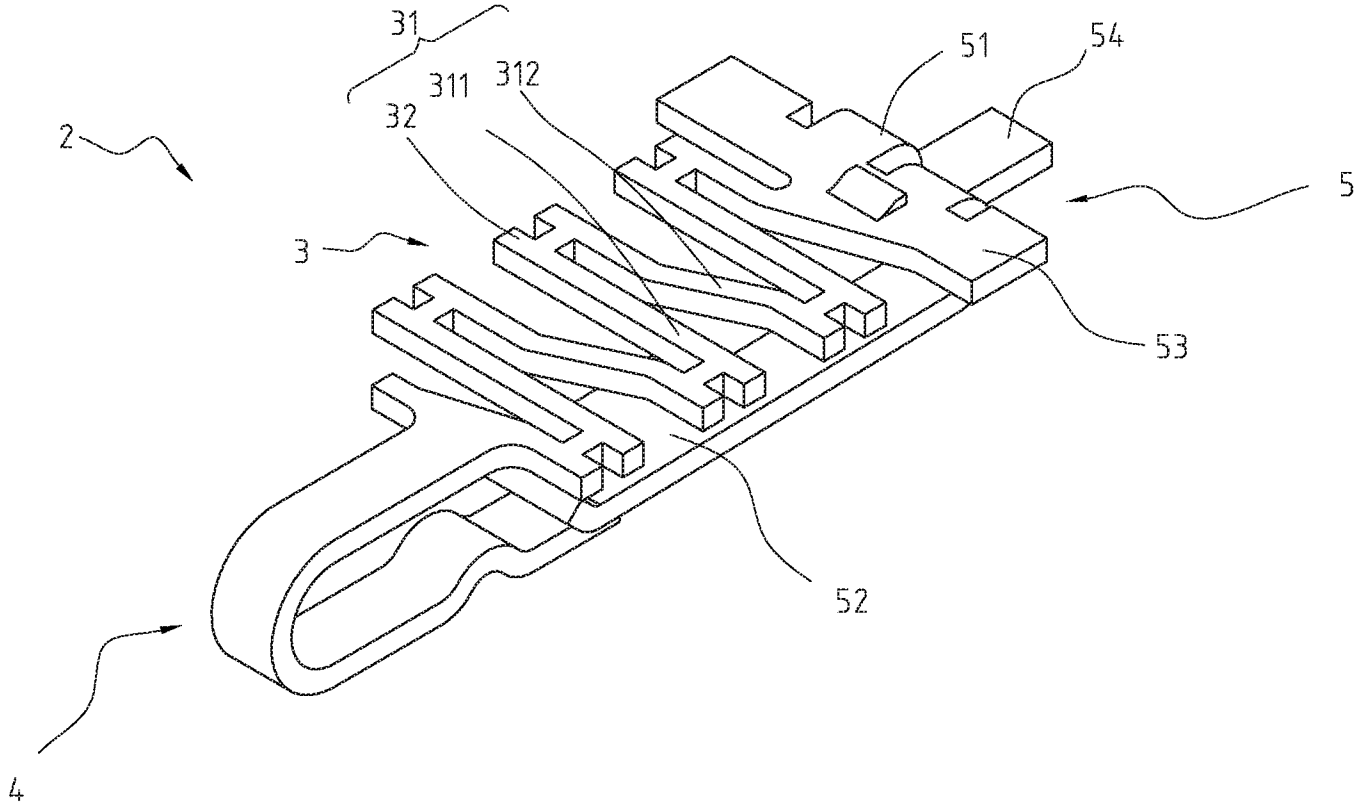
FIG. 3 illustrates a perspective view of a conductive terminal of the battery connector according to the first embodiment of the instant disclosure.

FIG. 1 illustrates a perspective view of a battery connector 100 according to a first embodiment of the instant disclosure. FIG. 2 illustrates an exploded view of the battery connector 100 according to the first embodiment of the instant disclosure. FIG. 3 illustrates a perspective view of a conductive terminal 2 of the battery connector 100 according to the first embodiment of the instant disclosure. The battery connector 100 is applicable for connecting with the battery of electronic product, such as smart phones. The battery connector 100 comprises an insulation housing 11 and a plurality of conductive terminals 2. A shell 6 is covering on the insulation housing 11, and fastening sheets extended from two sides of the shell 6 are capable of being soldered to a circuit board (not shown), such that the battery connector 100 is fastened with the circuit board.

Figure 4:
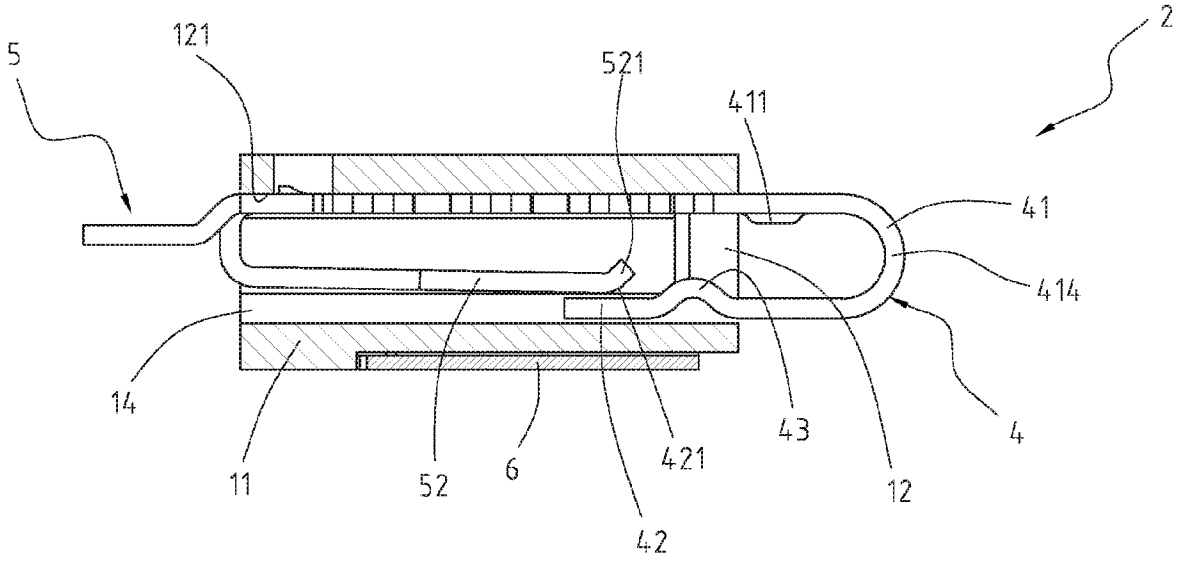
FIG. 4 illustrates a lateral sectional view (1) of the battery connector according to the first embodiment of the instant disclosure.

Please refer to FIG. 1, FIG. 2, and FIG. 4. The insulation housing 11 is a rectangular case and has a plurality of slots 12, a plurality of front openings 13, and a plurality of rear openings 14. The slots 12 are defined on the insulation housing 11 along a left-to-right direction and spaced from each other. Each of the front openings 13 is in communication with the front portion of the corresponding slot 12, and each of the rear openings 14 is in communication with the rear portion of the corresponding slot 12. Here, each of the slots 12 comprises a transverse groove 121. In other words, two recessed cavities are recessed from two opposite inner walls of each of the slots 12, respectively, the two recessed cavities of each of the slots 12 are symmetrical with each other, and the two recessed cavities are formed as the transverse groove 121. The cross section of each of the slots 12 is in T-shaped.

Please refer to FIG. 2, FIG. 3, and FIG. 4. The conductive terminals 2 are formed by stamping, bending or the like. Each of the conductive terminals 2 comprises an elastic connecting portion 3, a contact portion 4, and a fastening portion 5 formed integrally with each other. The elastic connecting portion 3 is assembled in the slot 12 and comprises a plurality of elastic arms 31 and a plurality of connecting portions 32. The elastic arms 31 are substantially aligned along a transversal direction and spaced from each other. In addition, the elastic arms 31 are aligned parallel with each other to form several parallel lines. In other words, the elastic arms 31 are plates aligned transversally, parallel to, and spaced from each other. Specifically, the elastic arms 31 comprise a plurality of transverse branch arms 311 aligned sequentially and a plurality of slant branch arms 312 each configured between two adjacent transverse branch arms 311. In other words, each adjacent two transverse branch arms 311 are connected by one slant branch arm 312. Particularly, one slant branch arm 312 is connected between a first end of one transverse branch arm 311 and a second end of another transverse branch arm 311, and so forth, such that the branch arms are formed as several N-shaped structures.

Figure 7:
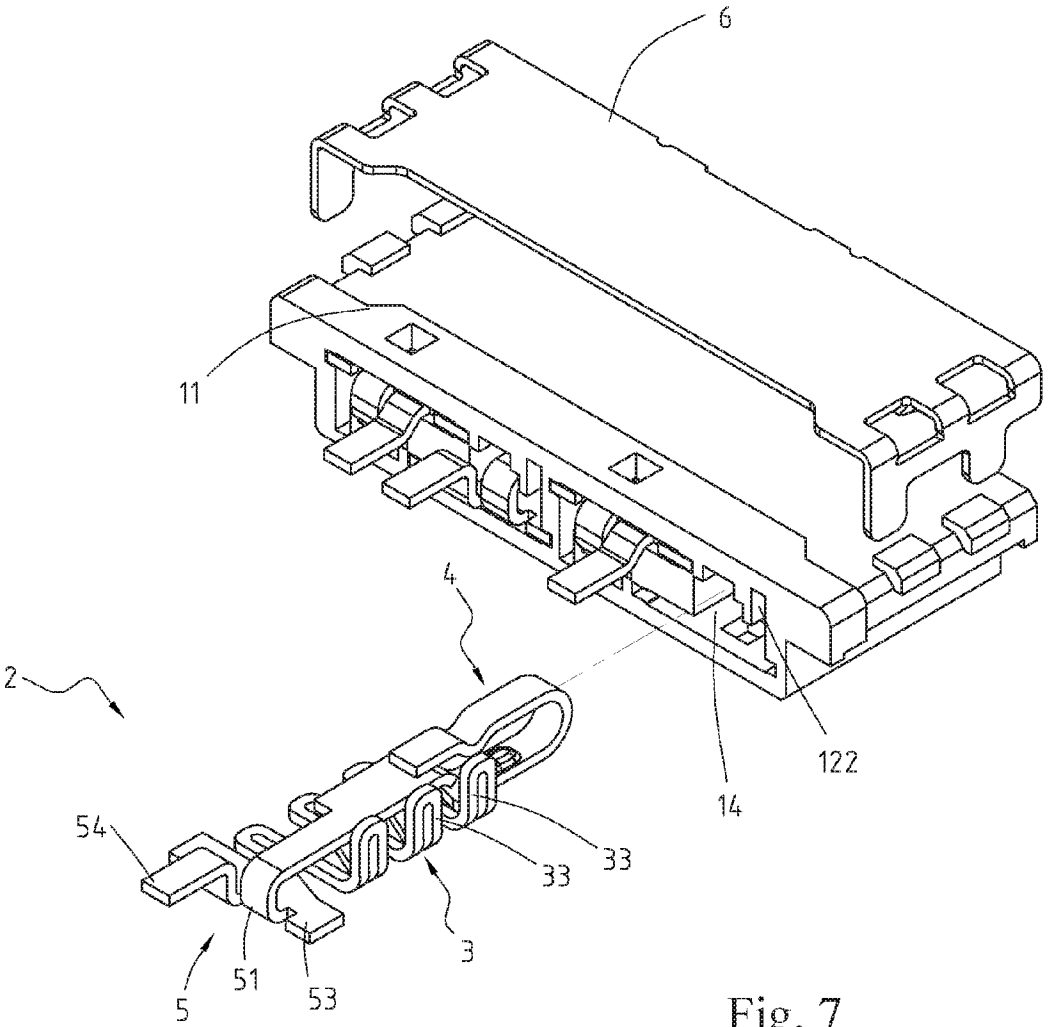
FIG. 7 illustrates an exploded view of a battery connector according to a second embodiment of the instant disclosure.

Please refer to FIG. 3 and FIG. 7. The connecting portions 32 are formed by stamping but rather than bending. Each of the connecting portions 32 is formed as a laid U-shaped structure or a laid H-shaped structure. The connecting portions 32 are formed at two sides of each of the elastic arms 31. That is, one connecting portion 32 is connected between a first end of one elastic arm 31 and a first end of adjacent elastic arm 31.

Figure 6:
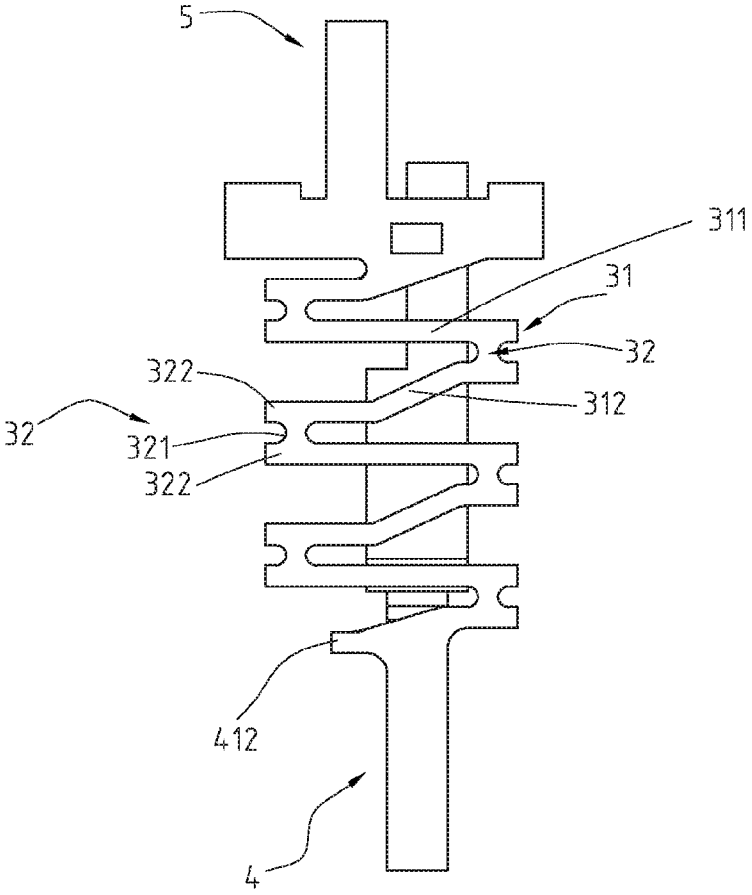
FIG. 6 illustrates a top view of the conductive terminal of the battery connector according to the first embodiment of the instant disclosure.

Please refer to FIG. 3 and FIG. 6. In the case that each of the connecting portions 32 is formed as an H-shaped structure, each of the connecting portions 32 comprises a transition section 321 and a plurality of extension sections 322. The transition section 321 is connected between the first end of one elastic arm 31 and the first end of adjacent elastic arm 31 or connected between the second end of one elastic arm 31 and the second end of adjacent elastic arm 31, and the extension sections 322 are extended from two ends of the transition section 321. Additionally, the extension sections 322 are distant from the two ends of the elastic arms 31. Accordingly, the transition section 321 and the extension sections 322 of each of the connecting portions 32 are collectively defined as the H-shaped structure. Besides, the transition section 321 and the extension sections 322 are manufactured by stamping.

Please refer to FIG. 6. In the case that each of the connecting portions 32 is formed as a U-shaped structure, one transition section 321 is formed between the first ends (or the second ends) of each two adjacent elastic arms 31. Specifically, a first connecting portion 32 is extended between the first end of the first elastic arm 31 and the second elastic arm 31, a second connecting portion is extended between the second end of the second elastic arm 31 and the third elastic arm 31, and so forth. That is, the elastic connecting portion 3 is a flexible structure defined by the elastic arms 31 and the connecting portions 32 connected between the elastic arms 31. When the conductive terminals 2 are held in the slots 12, the elastic arms 31 are held and received in the transverse grooves 121, respectively, as shown in FIG. 2 and FIG. 4.

If the elastic connecting portion 3 within a certain length has more elastic arms 31, the elasticity of the elastic connecting portion 3 will increase, allowing the contact portion 4 to be firmly in contact with the conductive piece of the battery. Therefore, the contact portion 4 of the conductive terminal 2 of the battery connector 100 can be firmly in contact with the battery, providing a high structural performance, even when the assembly of the battery and the battery connector 100 are shaken.

Please refer to FIG. 2, the elastic connecting portions 3 are alternately held in top locations and bottom locations of the slots 12, such that the conductive terminals 2 are held in the slots 12, with a one-to-one relationship. Specifically, a first conductive terminal 2 is held in a first slot 12 with a first orientation, a second conductive terminal 2 is held in a second slot 12 with a second orientation oriented in an upside down manner of the first orientation, a third conductive terminal 2 is held in a third slot 12 with the first orientation, and so forth. Accordingly, the size of the battery connector 100 can be reduced with the dense arrangement of the conductive terminals 2, and the manufacturing cost of the battery connector 100 can be reduced as well. Therefore, the space within the battery connector 100 can be utilized efficiently, and the battery connector 100 can be produced in a lightweight manner to meet various requirements.

As mentioned above, several elastic arms 31 are integrally formed as a flexible arm member capable of being compressed efficiently and providing sufficient elastic force. Therefore, when the battery connector 100 and the battery are shaken, the conductive terminals 2 of the battery connector 100 can still contact the conductive pieces of the battery, such that the battery can supply electricity normally, improving the reliability of the electronic product having the battery connector 100.

Figure 5:
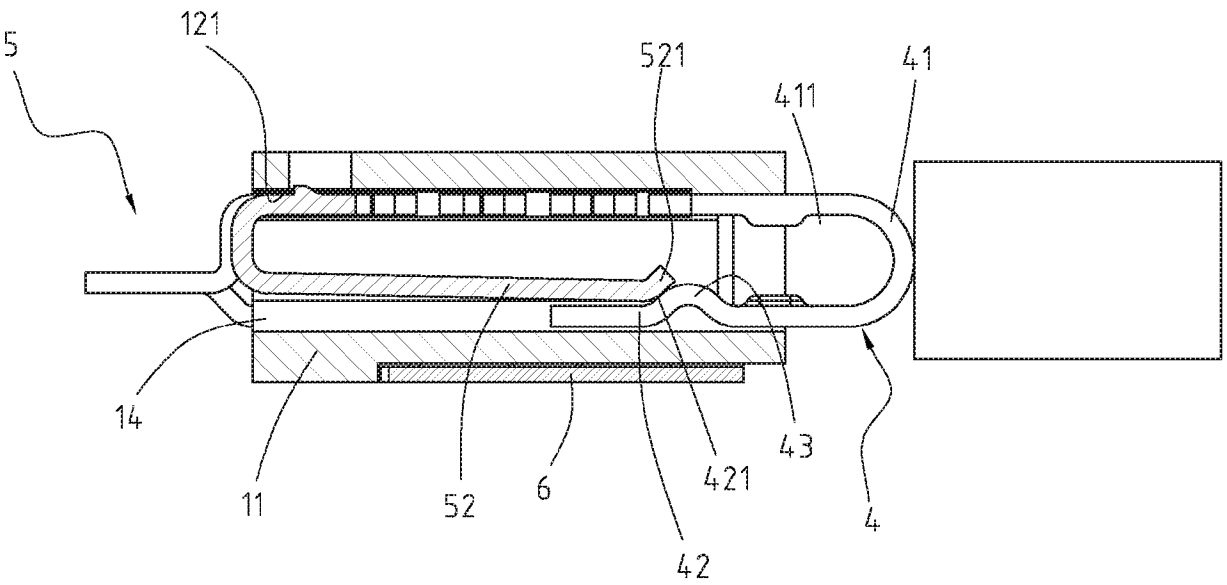
FIG. 5 illustrates a lateral sectional view (2) of the battery connector according to the first embodiment of the instant disclosure.

Please refer to FIG. 2, FIG. 4, and FIG. 5. The contact portions 4 are protruded from the front openings 13 to contact the battery. Each of the contact portions 4 comprises a bendable contact portion 414, an active contact arm 42, and a block 411. The bendable contact portion 414 is extended forwardly from the elastic connecting portion 3 and then folded and extended backwardly, the active contact arm 42 is formed at an end portion of the bendable contact portion 414, and the block 411 is formed on the bendable contact portion 414. In addition, the active contact arm 42 comprises a protruded portion 43.

Please refer to FIG. 2, FIG. 4, and FIG. 5. Here, the bendable contact portion 414 is approximately formed as a laid U-shaped structure, and the opening of the U-shaped structure is faced toward the fastening portion 5. In addition, the active contact arm 42 is extended backwardly from the end portion of the bendable contact portion 414.

Please refer to FIG. 2, FIG. 4, and FIG. 5. The bendable contact portion 141 of each of the contact portions 4 has the block 411 to improve the conduction and contact between the battery and the contact portion 4. Therefore, the electricity transmission between the battery and the conductive terminals 2 can be performed stably.

Please refer to FIG. 3 and FIG. 6. In addition, a stopping section 412 is extended laterally from the bendable contact portion 414. Therefore, when the conductive terminals 2 are installed in the slots 12 of the battery connector 100, the stopping section 412 is abutted against the inner wall of the slot 12 to allow an exposed portion of the contact portion 4 to be of a proper length, where the exposed portion of the contact portion 4 is protruded from the front opening 13. In other words, the stopping sections 412 allow the conductive terminals 2 to be positioned in the slots 12 properly.

Please refer to FIG. 2 and FIG. 4. The fastening portion 5 of each of the conductive terminals 2 is protruded from the corresponding rear opening 14. Each of the fastening portions 5 comprises a fastening piece 53, a soldering leg 54, a bent portion 51, and a passive contact arm 52. The fastening piece 53 is held in the slot 12. The soldering leg 54 may be an SMT (surface mount technology) soldering leg or a DIP (dual in-line package) soldering leg extended from the rear portion of the fastening piece 53 and exposed to the outside of the rear opening 14 when the conductive terminal 2 is installed in the slot 12. The bent portion 51 is extended backwardly form the elastic connecting portion 3 and then folded and extended forwardly. The passive contact arm 52 is formed at an end portion of the bent portion 51 and aligned with the active contact arm 42.

Please refer to FIG. 2 and FIG. 4. Here, the bent portion 51 is approximately formed as a laid U-shaped structure, and the opening of the U-shaped structure is faced toward the contact portion 4. In addition, the passive contact arm 52 is extended forwardly from the end portion of the bent portion 51, the fastening portion 5 is held in the slot 12, and the fastening piece 53 is held in the transverse groove 121.

Please refer to FIG. 4 and FIG. 5. Since the contact portion 4 is connected to the elastic connecting portion 3 which is elastic and flexible, the contact portion 4 can be abutted against the battery in a flexible manner. In addition, the passive contact arm 52 has a guiding portion 521 formed at the end portion thereof. When the contact portion 4 is moving, the protruded portion 43 of the active contact arm 42 is guided by the guiding portion 521 so as to be in contact with the passive contact arm 52. Therefore, the guiding portion 521 provides a guiding function. Here, when the battery is in contact with the contact portion 4, the active contact arm 42 connected to the contact portion 4 allows the protruded portion 43 to be in contact with the passive contact arm 52. In other words, when the contact portion 4 is not in contact with the battery, the protruded portion 43 is not in contact with the passive contact arm 52; conversely, when the contact portion 4 is contact with the battery, the abutting force provide by the battery pushes the contact portion 4 to move and allows the protruded portion 43 to be in contact with the passive contact arm 52, but embodiments are not limited thereto. In some embodiments, the protruded portion 43 is in contact with the passive contact arm 52 no matter the contact portion 4 is in contact with a battery or not.

Please refer to FIG. 3 and FIG. 5. When the conductive terminals 2 are installed in the slots 12, the fastening portions 5 are engaged in the transverse grooves 121. When the passive contact arm 52 is in contact with the protruded portion 43 of the contact portion 4 (i.e., when the contact portion 4 is in contact with the battery for electricity transmission), the electricity signal would be transmitted by a shortest transmitting path, so that the electricity signal is transmitted from the protruded portion 43 to the passive contact arm 52 through the connection therebetween. In other words, since the overall length of the elastic arms 31 is longer than the overall length of the active contact arm 42 and the passive contact arm 52, the electricity signal would be transmitted through connection between the active contact arm 42 and the passive contact arm 52. Therefore, the electricity transmission path can be reduced, and the normal force provided by the battery connector 100 can be increased.

Please refer to FIG. 3 and FIG. 5. In addition, the protruded portion 43 of the active contact arm 42 is detachably in contact with the passive contact arm 52. Here, the protruded portion 43 is not in contact with the passive contact arm 52 until the contact portion 4 is in contact with the battery. In other words, when the contact portion 4 is forced and compressed by the battery, the protruded portion 43 is in contact with the passive contact arm 52 and the electricity signal is thus transmitted, but embodiments are not limited thereto. In some implementation aspects, the protruded portion 43 is in contact with the passive contact arm 52 when the contact portion 4 is not in contact with the battery, and the protruded portion 43 is detached from the passive contact arm 52 when the contact portion 4 is in contact with the battery.

Figure 8:
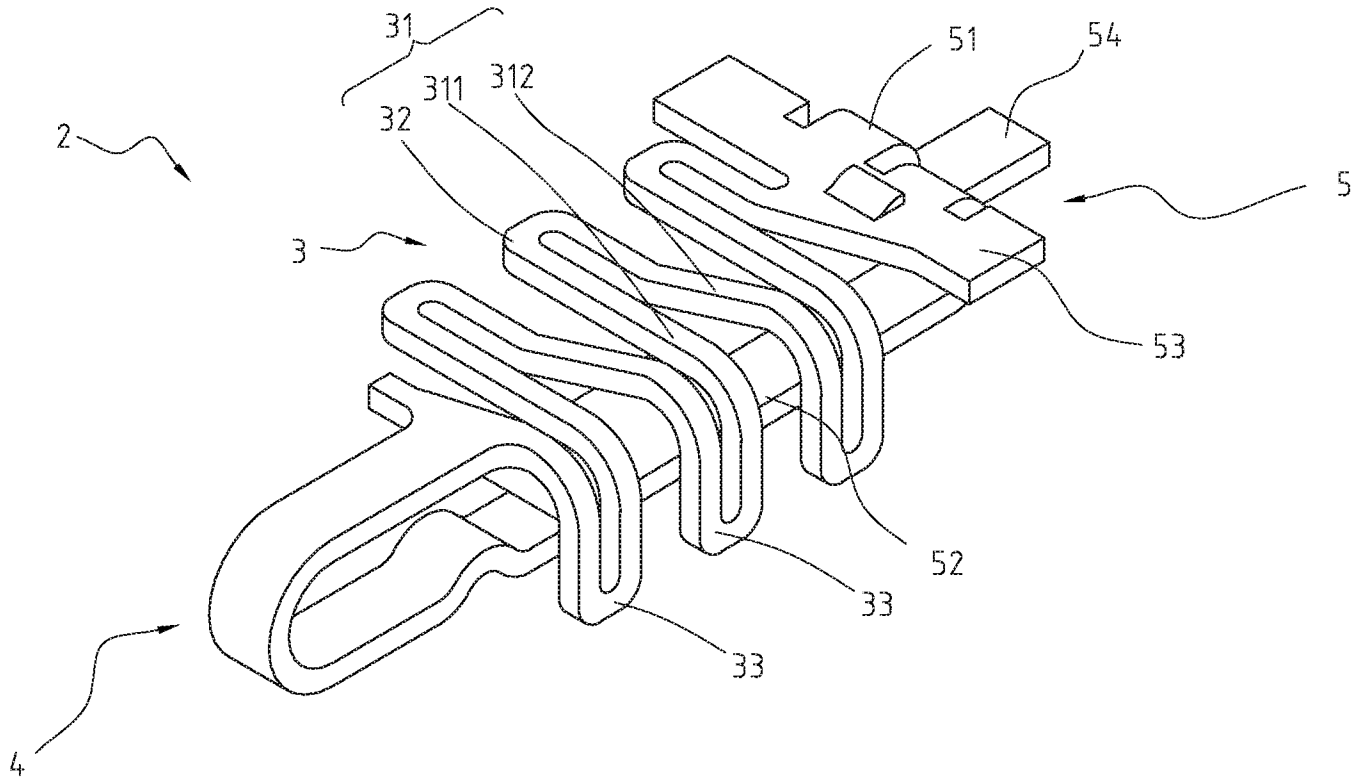
FIG. 8 illustrates a perspective view of a conductive terminal of the battery connector according to the second embodiment of the instant disclosure.

Please refer to FIG. 7 and FIG. 8, which provide a second embodiment of the instant disclosure. FIG. 7 illustrates an exploded view of a battery connector 100 according to a second embodiment of the instant disclosure. FIG. 8 illustrates a perspective view of a conductive terminal 2 of the battery connector 100 according to the second embodiment of the instant disclosure. The structure of the second embodiment is approximately the same as that of the first embodiment, except that in the second embodiment, the elastic connecting portion 3 comprises a plurality of side arms 33 extended from the two ends of the elastic arms 31 and substantially perpendicular to the elastic arms 31. The combination of the elastic arms 31 and the side arms 33 are in L-shaped. Here, each of the slots 12 comprises a longitudinal groove 122 for limiting the side arm 33. After the elastic arm 31 and the side arm 32 are respectively installed in the transverse groove 121 and the longitudinal groove 122, the elastic connecting portion 3 would be positioned properly within the slot 12 when the elastic connecting portion 3 is compressed. The elastic connecting portions 3 are alternately held in top locations and bottom locations of the slots 12, such that the conductive terminals 2 are installed in the slots 12, with a one-to-one relationship. In other words, a first conductive terminal 2 is held in a first slot 12 with a first orientation, a second conductive terminal 2 is held in a second slot 12 with a second orientation oriented in an upside down manner of the first orientation, a third conductive terminal 2 is held in a third slot 12 with the first orientation, and so forth. Accordingly, the size of the batter connector 100 can be reduced with the dense arrangement of the conductive terminals 2, and the manufacturing cost of the battery connector 100 can be reduced as well. Therefore, the space within the battery connector 100 can be utilized efficiently, and the battery connector 100 can be produced in a lightweight manner to meet various requirements.

According to embodiments of the instant disclosure, the conductive terminals are designed as spring like structures with I-profiled or L-profiled. The conductive terminals are capable of being compressed and providing sufficient elastic force. In addition, the fastening portion has a passive contact arm provided to be in contact with the protruded portion of the contact portion to shorten the electricity transmission path and to increase the normal force of the battery connector. Besides, the elastic connecting portions are alternately held in top locations and bottom locations of the slots, such that the conductive terminals are installed in the slots, with a one-to-one relationship. Therefore, the size of the batter connector can be reduced with the dense arrangement of the conductive terminals, and the manufacturing cost of the battery connector can be reduced as well. Additionally, the space within the battery connector can be utilized efficiently, and the battery connector can be produced in a lightweight manner to meet various requirements.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A battery connector terminal, comprising: an elastic connecting portion, comprising a plurality of elastic arms and a plurality of connecting portions, wherein the elastic arms are substantially aligned along a transversal direction, and the connecting portions are formed at two ends of each of the elastic arms; a contact portion, comprising a bendable contact portion and an active contact arm, wherein the bendable contact portion is extended forwardly from the elastic connecting portion and then folded and extended backwardly, and the active contact arm is formed at an end portion of the bendable contact portion; and a fastening portion, comprising a bent portion and a passive contact arm, wherein the bent portion is extended backwardly from the elastic connecting portion and then folded and extended forwardly, and the passive contact arm is formed at an end portion of the bent portion and aligned with the active contact arm; wherein the active contact portion comprises a protruded portion being detachably in contact with the passive contact arm.

2. The battery connector terminal according to claim 1, wherein the elastic connecting portion comprises a plurality of side arms extended from the two ends of the elastic arms and substantially perpendicular to the elastic arms.

3. The battery connector terminal according to claim 1, wherein each of the connecting portions comprises a transition section and a plurality of extension sections, wherein the transition section is connected between two ends of two adjacent elastic arms, and wherein the extension sections are extended from two ends of the transition section and distant from the two ends of the elastic arms.

4. The battery connector terminal according to claim 1, wherein the elastic arms comprise a plurality of transverse branch arms aligned sequentially and a plurality of slant branch arms each configured between two adjacent transverse branch arms.

5. The battery connector terminal according to claim 1, wherein the fastening portion comprises a fastening piece and a soldering leg extended from the rear portion of the fastening piece.

6. A battery connector, comprising:

an insulation housing comprising a plurality of slots, a plurality of front openings, and a plurality of rear openings, wherein each of the front openings is in communication with the front portion of the corresponding slot, and each of the rear openings is in communication with the rear portion of the corresponding slot; and a plurality of battery connector terminals according to claim 1, wherein the battery connector terminals are held in the slots by a one-to-one relationship, the contact portion of each of the battery connector terminals is protruded from the corresponding front opening, and the fastening portion of each of the battery connector terminals is protruded from the corresponding rear opening.

7. The battery connector according to claim 6, wherein the battery connector terminals are alternately held in top locations and bottom locations of the slots.

8. The battery connector according to claim 6, wherein each of the slots comprises a transverse groove and a longitudinal groove communicating with the longitudinal groove, the battery connector terminals are restricted by the transverse grooves and the longitudinal grooves.

9. The battery connector according to claim 6, further comprising a shell covering on the insulation housing.

* * * * *